US008475297B2

(12) United States Patent
Chou et al.

(10) Patent No.: US 8,475,297 B2
(45) Date of Patent: Jul. 2, 2013

(54) GOLF BALL WITH CARBON DIOXIDE ABSORBENTS

(75) Inventors: Chien-Hsin Chou, Yun-Lin Hsien (TW); Chen-Tai Liu, Yun-Lin Hsien (TW); Chia-Chyi Cheng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/033,407

(22) Filed: Feb. 23, 2011

(65) Prior Publication Data

US 2012/0046126 A1 Feb. 23, 2012

(51) Int. Cl.
*A63B 37/04* (2006.01)

(52) U.S. Cl.
USPC ..... 473/371; 473/374; 473/378

(58) Field of Classification Search
USPC ..... 473/351–378
See application file for complete search history.

(56) References Cited

U.S. PATENT DOCUMENTS

| | | | | |
|---|---|---|---|---|
| 4,305,851 | A * | 12/1981 | Tominaga et al. | 525/195 |
| 4,528,228 | A | 7/1985 | Clevenger | |
| 4,857,368 | A | 8/1989 | Klein | |
| 4,955,966 | A * | 9/1990 | Yuki et al. | 473/359 |
| 5,371,113 | A | 12/1994 | Ward, III et al. | |
| 5,461,109 | A * | 10/1995 | Blair et al. | 524/839 |
| 5,817,728 | A * | 10/1998 | Higuchi et al. | 527/300 |
| 5,820,488 | A | 10/1998 | Sullivan et al. | |
| 5,823,889 | A * | 10/1998 | Aoyama | 473/374 |
| 5,984,806 | A * | 11/1999 | Sullivan et al. | 473/373 |
| 6,042,638 | A | 3/2000 | Mallow et al. | |
| 6,103,787 | A * | 8/2000 | Rajagopalan et al. | 523/351 |
| 6,435,146 | B1 | 8/2002 | Kantola et al. | |
| 6,435,986 | B1 * | 8/2002 | Wu et al. | 473/378 |
| 6,451,423 | B1 | 9/2002 | Armat et al. | |
| 6,632,146 | B1 | 10/2003 | Halko et al. | |
| 6,767,294 | B2 * | 7/2004 | Nesbitt | 473/369 |
| 6,794,472 | B2 * | 9/2004 | Harris et al. | 526/262 |
| 6,808,461 | B2 * | 10/2004 | Harris et al. | 473/370 |
| 7,083,532 | B2 * | 8/2006 | Ohama | 473/371 |
| 7,179,856 | B2 | 2/2007 | Park et al. | |
| 7,182,702 | B2 | 2/2007 | Hogge et al. | |
| 7,226,961 | B2 | 6/2007 | Park et al. | |
| 7,393,289 | B2 * | 7/2008 | Egashira et al. | 473/351 |

(Continued)

FOREIGN PATENT DOCUMENTS

| | | | |
|---|---|---|---|
| JP | 55059825 | | 5/1980 |
| JP | 2002219193 | A * | 8/2002 |
| NL | 1030771 | | 6/2007 |
| WO | 9831542 | | 7/1998 |

OTHER PUBLICATIONS

International Search Report and Written Opinion in PCT application No. PCT/US2012/026167, mailed on Sep. 28, 2012.

(Continued)

*Primary Examiner* — Alvin Hunter
(74) *Attorney, Agent, or Firm* — Plumsea Law Group, LLC

(57) ABSTRACT

This disclosure provides a golf ball that includes carbon dioxide absorbents in order that the golf ball may reduce atmospheric carbon dioxide levels to aid in alleviating global warming. The golf ball may include an intermediate layer that is substantially impermeable to water, in order to ensure that the golf ball's core is not degraded by water produced by the carbon dioxide absorbance reaction. The chemical absorbents may be encapsulated in microcapsules so that carbon dioxide is not absorbed until the golf ball is used by a golfer.

17 Claims, 6 Drawing Sheets

U.S. PATENT DOCUMENTS

| | | | | |
|---|---|---|---|---|
| 7,465,482 | B2 * | 12/2008 | Yamazaki et al. | 428/35.7 |
| 7,614,965 | B2 * | 11/2009 | Shindo et al. | 473/351 |
| 7,682,662 | B2 | 3/2010 | Sasaki | |
| 7,727,309 | B2 | 6/2010 | Robertson et al. | |
| 2003/0069082 | A1 | 4/2003 | Sullivan | |
| 2004/0266555 | A1 | 12/2004 | Park et al. | |
| 2008/0085783 | A1 | 4/2008 | Isogawa et al. | |
| 2009/0082137 | A1 | 3/2009 | Okabe | |
| 2010/0000852 | A1 | 1/2010 | Curtin et al. | |
| 2010/0210745 | A1 * | 8/2010 | McDaniel et al. | 521/55 |
| 2010/0248862 | A1 | 9/2010 | Sullivan et al. | |

OTHER PUBLICATIONS

International Search Report and Written Opinion in PCT application No. PCT/US2012/026168, mailed on Sep. 28, 2012.

Office Action for U.S. Appl. No. 13/033,428 mailed on Jun. 22, 2012.

Final Office Action for U.S. Appl. No. 13/033,428 mailed on Dec. 19, 2012.

* cited by examiner

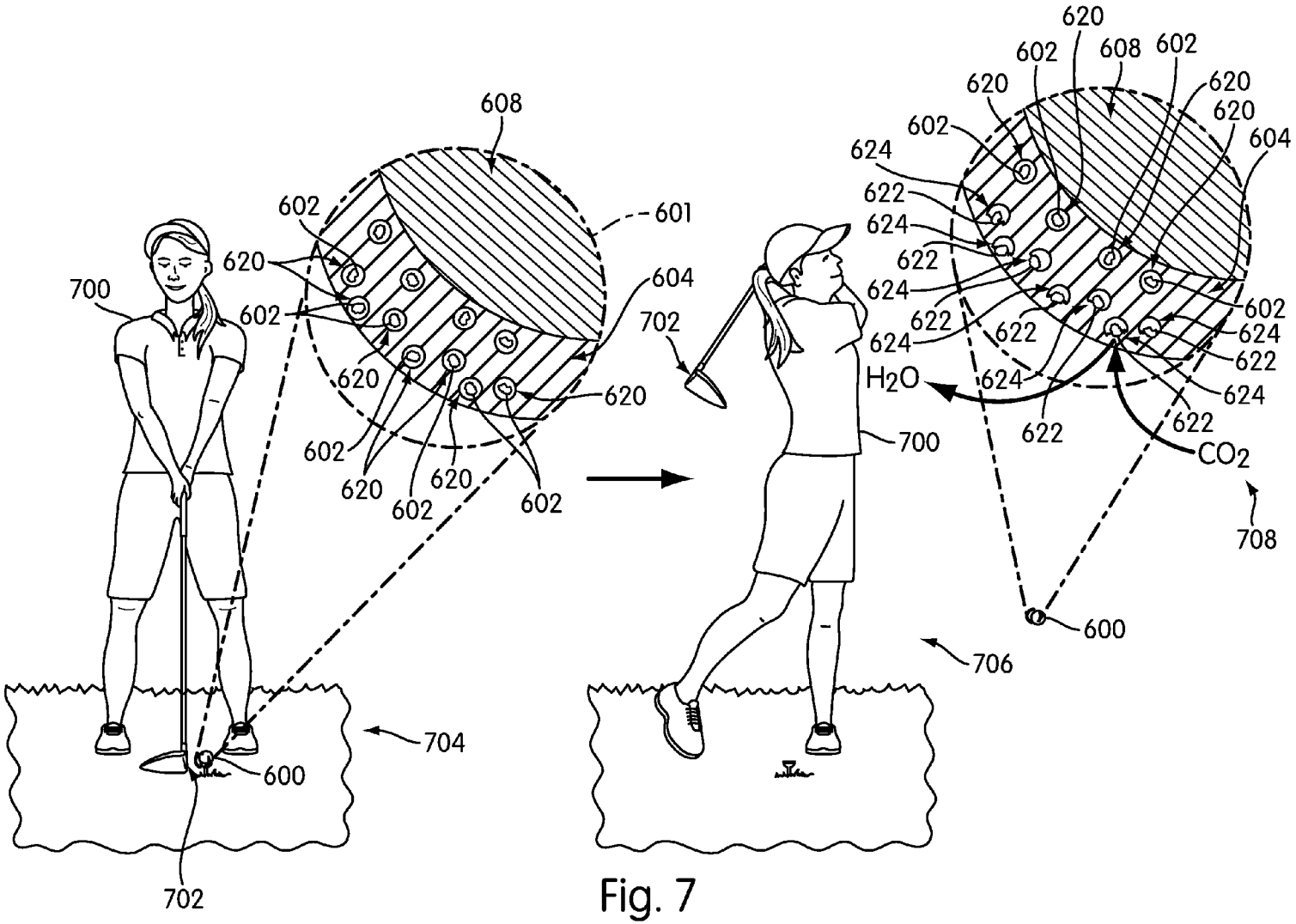
604
620
620
602
608
620
602
620
602
624
622
624
622
624
622

GOLF BALL WITH CARBON DIOXIDE ABSORBENTS

BACKGROUND

The present disclosure relates generally to the field of golf balls. Specifically, the present disclosure relates to a golf ball containing carbon dioxide absorbents.

The game of golf is an increasingly popular sport at both the amateur and professional levels. Unfortunately, the game of golf may be considered by some to be less than ideally environmentally friendly. The manufacture, transportation, maintenance, and use of golf balls and golf equipment may have a high environmental impact. Namely, the manufacture of golfing equipment may be energy intensive, and may require materials that are not necessary "green." Global warming in particular is considered to be an important environmental concern. A wide range of industries are undertaking measures to reduce their emissions of the green house gases that contribute to global warming.

In the golf ball industry, various technologies have sought to reduce green house gas emissions through increased energy efficiency. However, few technologies have enabled the golf ball itself to play a role in the fight against global warming.

U.S. Patent Application Publication No. 2009/0082137 to Okabe discusses how golf balls might be made more "carbon neutral" through the use of non-petroleum based polymer materials. Specifically, the use of non-petroleum based materials in golf balls may prevent an increase in the amount of atmospheric carbon dioxide, as renewable materials do not add any new carbon dioxide to the atmosphere whereas petroleum products release previously sequestered carbon dioxide. As a result of this prevention of an increase in carbon dioxide levels, this golf ball may thereby help prevent global warming. However this golf ball could at best be only carbon neutral, and is not capable of reducing the total amount of carbon dioxide in the atmosphere.

Therefore, there is a need in the art for a golf ball that helps reduce greenhouse gases, for example, carbon dioxide.

SUMMARY

Generally, this disclosure provides golf balls containing carbon dioxide absorbents. The carbon dioxide absorbents may absorb carbon dioxide from the atmosphere upon use by a golfer, so that the act of golfing may help combat global warming.

In one aspect, this disclosure provides a golf ball comprising: a carbon dioxide absorbent selected from the group consisting of alkaline hydroxides, alkaline oxides, alkali hydroxides, alkali oxides, and mixtures thereof; the carbon dioxide absorbent being dispersed within a polymer matrix, the polymer matrix constituting a structural component of the golf ball.

In another aspect, this disclosure provides a golf ball comprising: a carbon dioxide absorbent selected from the group consisting of alkaline hydroxides, alkaline oxides, alkali hydroxides, alkali oxides, and mixtures thereof; the carbon dioxide absorbent being dispersed within a polymer matrix, the polymer matrix constituting a structural component of the golf ball; wherein the carbon dioxide absorbent is encapsulated within a plurality of microcapsules; the microcapsules being comprised of a material that is substantially impermeable to carbon dioxide; the plurality of microcapsules being frangible, such that at least some of the plurality of microcapsules break as a result of a force applied by a golf club face to the golf ball during a drive, thereby exposing the carbon dioxide absorbent therein to atmospheric carbon dioxide; and the plurality of microcapsules being dispersed within the polymer matrix.

Finally, this disclosure also provides a golf ball comprising a core; an intermediate layer substantially surrounding the core, the intermediate layer being substantially impermeable to water; a cover layer substantially surrounding the intermediate layer; a carbon dioxide absorbent selected from the group consisting of alkaline hydroxides, alkaline oxides, alkali hydroxides, alkali oxides, and mixtures thereof; the carbon dioxide absorbent being dispersed within a polymer matrix, the polymer matrix corresponding to the cover layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 7 shows a golfer striking the golf ball of FIG. 6 with a golf club during a drive.

DETAILED DESCRIPTION

Figure 1:
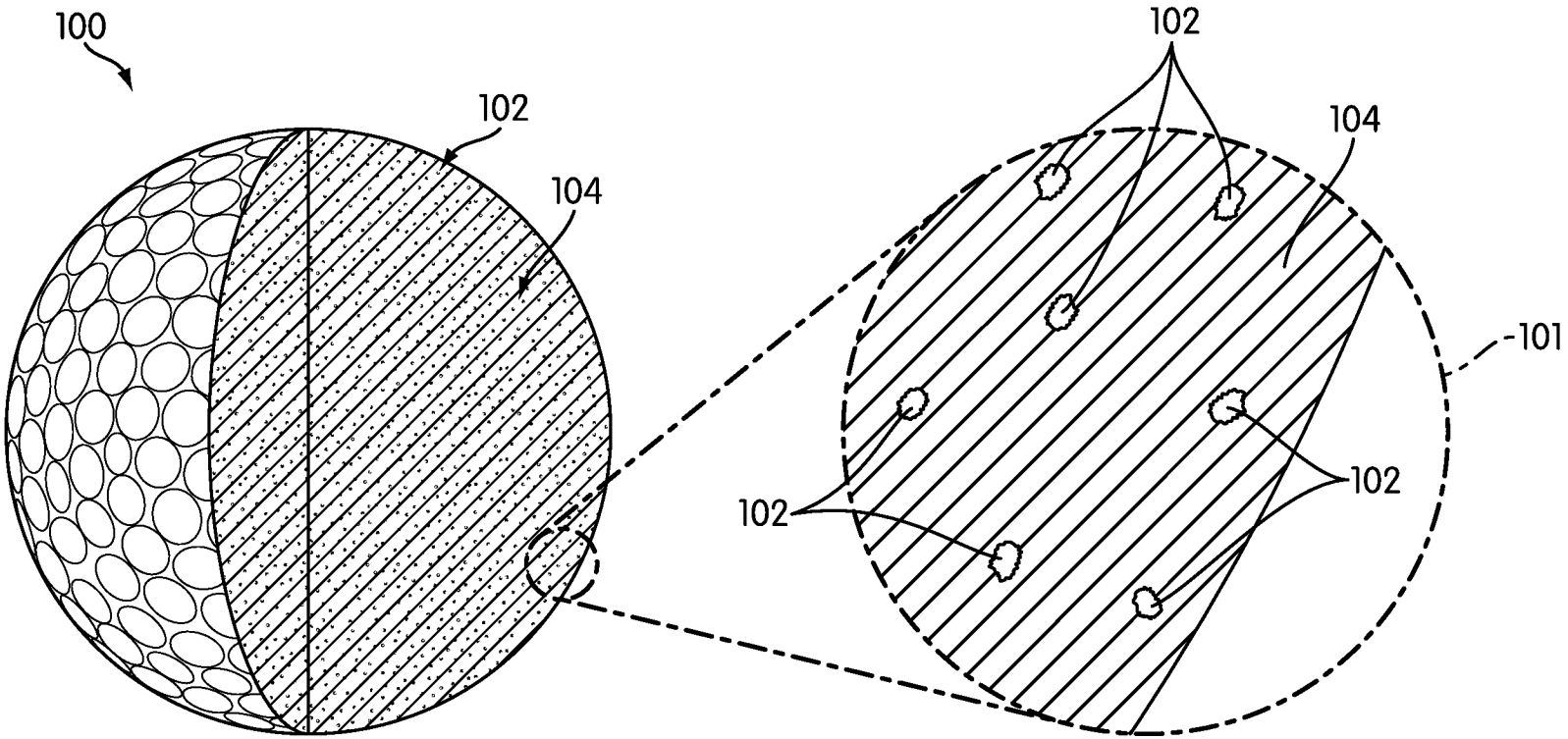
FIG. 1 shows an embodiment of a one-piece golf ball including carbon dioxide absorbents.

This disclosure relates generally to golf balls that include a carbon dioxide absorbent therein. The carbon dioxide absorbent may absorb atmospheric carbon dioxide so as to reduce the total amount of green house gasses in the atmosphere, thereby helping to alleviate global warming. The use of such a golf ball including a carbon dioxide absorbent makes the act of playing golf an environmentally friendly activity.

Generally, the carbon dioxide absorbent may be any composition that is capable of reacting with atmospheric carbon dioxide so as to form reaction products that include less carbon dioxide. In some embodiments, the carbon dioxide absorbent may be a base. The base may react with the carbon dioxide in an acid/base reaction to form a salt and water. In other embodiments, the carbon dioxide absorbent may be activated carbon, or an amine gas sweetening composition, for example. A wide variety of carbon dioxide absorbents are known the gas-scrubbing field.

In some embodiments, the carbon dioxide absorbent may be a strong base such as alkaline hydroxides, alkaline oxides, alkali hydroxides, alkali oxides, or mixtures thereof. Any of these compounds may generally act as the carbon dioxide absorbent, however heavier elements may have drawbacks such as price or toxicity. The chemical reaction between these hydroxides or oxides and carbon dioxide may be seen with respect to calcium hydroxide and calcium oxide, for example:

$$CaO+H_2O \rightarrow Ca(OH)_2 \quad \text{Reaction (1)}$$

$$Ca(OH)_2+CO_2 \rightarrow CaCO_3+H_2O \quad \text{Reaction (2)}$$

In other words, alkaline oxides or alkali oxides such as calcium oxide may absorb and react with water in the atmosphere to form alkaline hydroxides or alkali hydroxides, respectively, such as calcium hydroxide (Reaction 1). Then, the alkaline hydroxide or alkali hydroxide such as calcium hydroxide may react with atmospheric carbon dioxide to form a metal salt such as calcium carbonate and water (Reaction 2). As is known in the art, these particular calcium based carbon dioxide absorbents may also be referred to as lime. Namely, calcium oxide may also be referred to as burnt lime or quicklime, while calcium hydroxide may also be referred to as slaked lime or slack lime.

As mentioned, oxides may require the presence of water in order to react in situ to form hydroxides, which then react with carbon dioxide. However, these oxides are themselves considered carbon dioxide absorbents as that phrase is used herein because the presence of water in the atmosphere will generally be sufficient for Reaction 1 to proceed to at least some degree.

Alternatively, an alkaline hydroxide or alkali hydroxide such as sodium hydroxide may be used without also including an oxide. For example, sodium hydroxide may be used as the carbon dioxide absorbent, and may react with carbon dioxide according to the formula:

$$2NaOH+CO_2 \rightarrow Na_2CO_3+H_2O \quad \text{Reaction (3)}$$

In other words, two sodium hydroxide molecules react with one carbon dioxide molecule to form sodium carbonate and water. As is known in the art, sodium hydroxide may also be referred to as lye or caustic soda.

In particular embodiments, calcium oxide (CaO), calcium hydroxide ($Ca(OH)_2$), sodium hydroxide (NaOH), lithium hydroxide (LiOH), and potassium hydroxide (KOH), and mixtures thereof may be used as the carbon dioxide absorbent. These strong metallic bases are readily available at economically feasible rates and react effectively with atmospheric carbon dioxide.

Generally, a salt may be formed as a result of the reaction between the carbon dioxide absorbent and the atmospheric carbon dioxide. The presence of this salt may cause the golf ball to increase in weight. This increase in weight may be largely negligible, or the increase in weight may be sufficient to be measurable and affect the play characteristics of the golf ball. The United States Golf Association (USGA) official Rules of Golf require that a regulation golf ball weigh no more than 45.93 grams. Therefore, a golf ball in accordance with this disclosure may be manufactured to weigh some amount less than 45.93, so that the golf ball may increase in weight as atmospheric carbon dioxide is absorbed. For example, a finished golf ball manufactured in accordance with this disclosure may weigh 45.5 grams before absorbing any significant amount of atmospheric carbon dioxide.

The carbon dioxide absorbent exists in the finished golf ball in a form that is capable of reacting with atmospheric carbon dioxide. Therefore, the strong metallic base must be substantially unreacted (i.e. not a salt) upon completion of manufacturing of the golf ball and first use of the golf ball by a golfer. In the golf ball manufacturing arts, compounds such as calcium oxide, calcium hydroxide, sodium hydroxide, and other strong bases are known to be used as neutralizing agents or activating agents. However, in such cases, the compound itself is not present in the final golf ball, but instead reacts with another chemical in the golf ball's composition such as an acidic polymer to form a salt. Therefore, only golf balls having the above mentioned chemicals in the final, finished composition are within the scope of this disclosure.

The carbon dioxide absorbent discussed above may be dispersed within a polymer matrix, where the polymer matrix may correspond to a structural component of the golf ball. The dispersion of carbon dioxide absorbents into a polymer matrix is discussed, for example, in U.S. Pat. No. 6,451,423 to Armat et al, the disclosure of which is hereby incorporated by reference in its entirety. Generally, in embodiments where the carbon dioxide absorbent is a solid, the carbon dioxide absorbent may be ground into fine particles or flakes. In various embodiments, the fine particles or flakes may have an number average particle size diameter of from about 0.5 μm to about 100 μm, or from about 0.5 μm to about 50 μm, or from about 0.5 μm to about 10 μm, or from about 0.5 μm to about 5 μm, or any intermediate points within these ranges.

The fine particles or flakes of carbon dioxide absorbent may then be physically intermixed with a polymer material through an extruder or other such known processing equipment, as is generally known in the art and discussed in U.S. Pat. No. 6,451,423 to Armat et al. In various embodiments, the carbon dioxide absorbent may comprise from about 1% to about 30% by weight of the polymer matrix, or from about 1% to about 20%, or from about 1% to about 10%, or from about 1% to about 5%, or any intermediate points within these ranges.

Broadly, a golf ball according to this disclosure may be of any general ball construction known in the art of manufacturing golf balls. For example, in various embodiments, the construction of the golf ball may be a one-piece ball, a two-piece ball, or a multi-piece ball.

FIG. 1 shows a first embodiment of a golf ball in accordance with this disclosure. Golf ball 100 is a one-piece ball, made of the same material 104 throughout its entirety. As is generally known in the art, material 104 used to make up the one-piece golf ball may be a synthetic rubber. Golf ball 100 also includes carbon dioxide absorbents 104. Carbon dioxide absorbents 104 may be dispersed within material 104. In other words, material 104 may be a polymer matrix within which particles of carbon dioxide absorbent 104 are dispersed. In this one-piece ball, carbon dioxide absorbents 104 may be dispersed throughout the entirety of material 104. Alternatively, in other embodiments, carbon dioxide absorbents 104 may be located (for example) in an outer region of material 104, so that atmospheric carbon dioxide may more easily penetrate into golf ball 100 and reach the carbon dioxide particles 104.

Close-up view 101 of a portion of golf ball 100, as shown in FIG. 1, shows further detail of the carbon dioxide absorbent particles 102. Carbon dioxide absorbent particles 102 may be numerous in relation to the amount of polymer matrix material 104, in order to achieve a high loading level. As mentioned above, carbon dioxide absorbent particles 102 may generally comprise from about 1% to about 30% by weight of the material 104. Also as discussed above, carbon dioxide absorbent particles 102 may have any of a variety of particle sizes ranging from an average of 0.5 μm to an average of about 100 μm.

Figure 2:
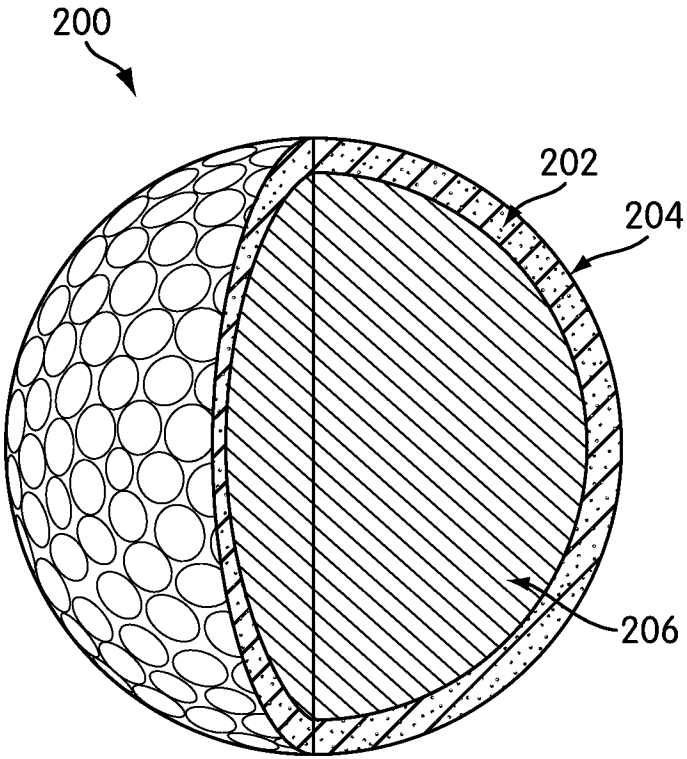
FIG. 2 shows an embodiment of a two-piece golf ball including carbon dioxide absorbents in a cover layer.

FIG. 2 shows a second embodiment of a golf ball in accordance with this disclosure. Golf ball 200 is a two-piece golf ball. Golf ball 200 therefore includes at least cover layer 204 and core 206. Cover layer 204 substantially surrounds core 206 and includes a plurality of dimples thereon. Two-piece golf ball 200 may generally be manufactured in accordance with known methods and materials for manufacturing two-piece golf balls. In the embodiment shown in FIG. 2, cover layer 204 includes carbon dioxide absorbent particles 204 dispersed therein. In order words, carbon dioxide absorbent particles 204 may be dispersed in a polymer matrix, where the polymer matrix corresponds to cover layer 204. As a result of this configuration where the carbon dioxide absorbent particles 204 are located on an outermost layer (cover layer 204), atmosphere carbon dioxide gas may easily diffuse into cover layer 204 and react with carbon dioxide absorbent particles 204.

Although the embodiment shown in FIG. 2 only includes carbon dioxide absorbent particles 204 in cover layer 204, in other embodiments core 206 may also include carbon dioxide absorbent particles 204. Alternatively, in yet other embodiments, core 206 may include carbon dioxide absorbent particles 204 while cover layer 204 may not include carbon dioxide absorbent particles 204. The carbon dioxide absorbent particles 204 may generally be located in any component of golf ball 200. The location of carbon dioxide absorbent particles 204, as well as the loading level weight percentage and particle size, may be determined according to factors such as available processing equipment, the desired reaction rate, and economic feasibility, among others.

In particular, carbon dioxide absorbent particles 204 may be in the form of as fine particles, and may be mixed with cover materials such as thermoplastic materials (for example: ionomer resin, highly neutralized acid polymer composition, polyamide resin, polyester resin, polyurethane resin) or thermoset materials (for example: polyurethane elastomers, polyamide elastomers, polyurea elastomers, diene-containing polymer, crosslinked metallocene catalyzed polyolefin, and silicone). The carbon dioxide absorbents of this invention may also be blended with other polymer as a masterbatch.

Figure 3:
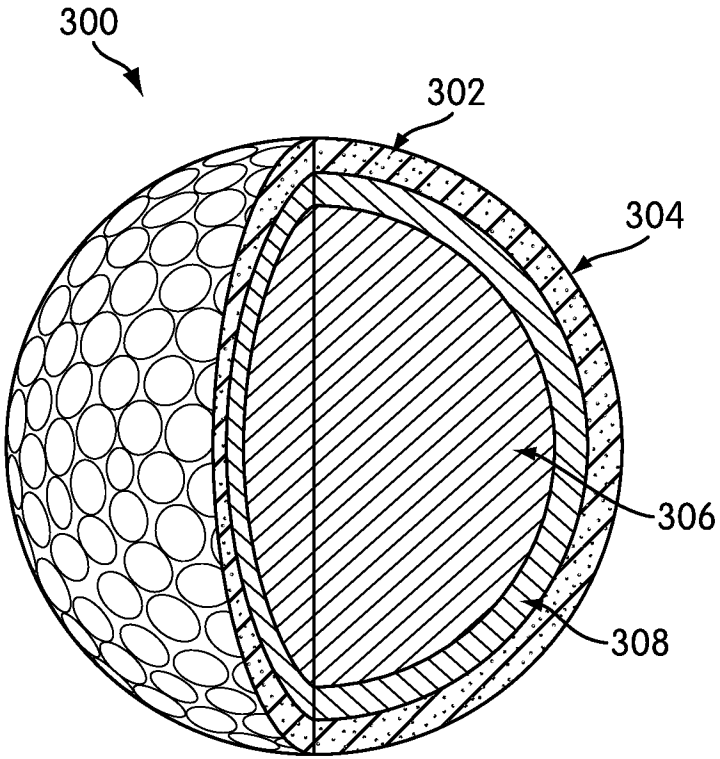
FIG. 3 shows an embodiment of a three-piece golf ball including carbon dioxide absorbents in a cover layer.

FIG. 3 shows a third embodiment of a golf ball in accordance with this disclosure. Golf ball 300 is a three-piece golf ball. Golf ball 300 includes at least core 306, intermediate layer 308 substantially surrounding core 306, and cover layer 304 substantially surrounding intermediate layer 308. Golf ball 300 may generally be manufactured in accordance with well known methods and materials for manufacturing three-piece golf balls.

In the embodiment shown in FIG. 3, golf ball 300 includes carbon dioxide absorbent particles 302 in cover layer 304. However, in other embodiments not shown, carbon dioxide absorbent particles 302 may be present in other layers of a three-piece golf ball. For example, carbon dioxide absorbent particles 302 may be present in each of core 306, intermediate layer 308 and cover layer 304; or carbon dioxide absorbent particles 302 may be present in only one of core 306, intermediate layer 308 or cover layer 304; or any combination thereof.

In particular embodiments, intermediate layer 308 may be moisture barrier layer that is substantially impermeable to water. Water is known to have adverse effects on the physical properties of the core. Specifically, the presence of water in a golf ball core disadvantageously decreases the coefficient of restitution (COR) of the golf ball. As discussed above, water is produced during the chemical reaction by which carbon dioxide gas is absorbed. Therefore, water may accumulate within the golf ball as a result of the carbon dioxide absorbance reaction. This water will tend to degrade the performance of the golf ball over time by reducing the COR. Accordingly, a moisture barrier layer may be included in the golf ball in order to isolate the core from the carbon dioxide absorbent particles.

U.S. Pat. No. 7,182,702 to Hogge, et al. discuses the problem of water degrading a golf ball core, and discloses a golf ball with a vapor barrier layer therein. The disclosure of U.S. Pat. No. 7,182,702 to Hogge, et al. is hereby incorporated by reference in its entirety. The vapor barrier layer disclosed therein may be comprised of butyl rubber, and may function to prevent reduction in the resiliency of the core due to the presence of water therein.

U.S. Pat. No. 5,820,488 to Sullivan et al. also discusses how water may adversely affect a golf ball core, and discloses a moisture barrier located between the core and cover layer. The disclosure of U.S. Pat. No. 5,820,488 to Sullivan et al. is hereby incorporated by reference in its entirety. The moisture barrier disclosed therein may be made of materials such as polyvinylidene chloride, vermiculite, or a flouridated polymer material.

In particular embodiments, intermediate layer 308 may be comprised of a hydrophobic thermoplastic polyurethane. U.S. Pat. No. 6,435,986 to Wu et al. discloses advantageous hydrophobic thermoplastic polyurethanes that may be used in golf balls. The disclosure of U.S. Pat. No. 6,435,986 to Wu et al. is hereby incorporated by reference in its entirety.

Generally, intermediate layer 308 may be comprised of any of the above-discussed materials, or other materials that are substantially impermeable to water. The selection of the particular material used as intermediate layer 308 may depend on factors such as: the degree to which the material is impermeable to water, the material's hardness, the material's resilience, and economic feasibility, among other factors.

Intermediate layer 308 may generally have a thickness of from about 0.1 mm to about 2 mm. FIG. 3 shows intermediate layer 308 as being of about the same thickness as cover layer 304. However, in other embodiments, the thickness of intermediate layer 308 may be substantially different from the thickness of cover layer 304. Thickness values are also discussed in U.S. Pat. No. 6,435,986 to Wu et al. and U.S. Pat. No. 5,820,488 to Sullivan et al. A person having ordinary skill in the art may select the thickness of the intermediate layer as may be desired for the overall construction of golf ball 300.

Figure 4:
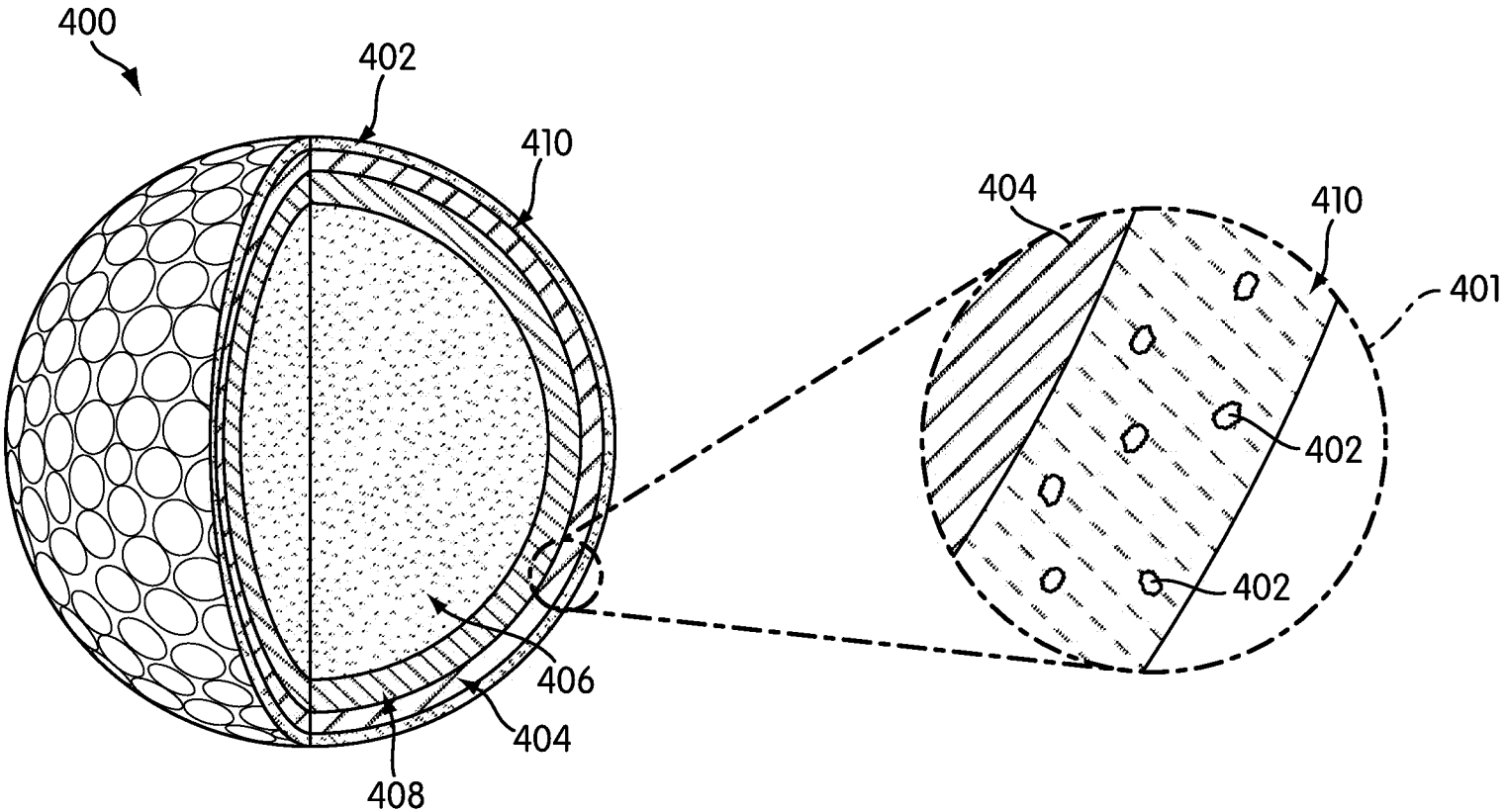
FIG. 4 shows an embodiment of a three-piece golf ball having a coating layer that includes carbon dioxide absorbents.

FIG. 4 shows a fourth embodiment of a golf ball in accordance with this disclosure. Golf ball 400 includes core 406, intermediate layer 408 substantially surrounding core 406, cover layer 404 substantially surrounding intermediate layer 408, and coating layer 410 substantially surrounding cover layer 404. In some embodiments, coating layer 410 may be adjacent to cover layer 404.

As shown in FIG. 4, coating layer 410 may include carbon dioxide absorbent particles 402. In other embodiments not shown, golf balls including one or more coating layers may include carbon dioxide absorbent particles in any of its several layers, or any combination or sub-combination thereof. For example, in one embodiment, a golf ball may include carbon dioxide absorbent particles in both its cover layer and coating layer.

In the particular embodiment shown in FIG. 4, carbon dioxide absorbent particles 402 are dispersed in coating layer 410. In other words, carbon dioxide absorbent particles 402 are dispersed in a polymer matrix, where the polymer matrix corresponds to coating layer 410.

Coating layers are generally known in the art of golf ball manufacturing. Coating layers may include, for example, clear coating, paint coating, sealant layers, or other thin marking layers that are located on top of the cover layer. Coating layer 410 may generally have a thickness of from about 10 μm to about 30 μm, or any intermediate point within that range.

In the embodiment shown in FIG. 4, coating layer 410 is a single layer that is disposed adjacent cover layer 404. Single layer coating layers may be composed of, for example, polyurethane. U.S. Pat. No. 5,461,109 to Blair et al. discloses a representative polyurethane single coating layer for golf balls. The disclosure of U.S. Pat. No. 5,461,109 to Blair et al. is hereby incorporated by reference in its entirety.

Figure 5:
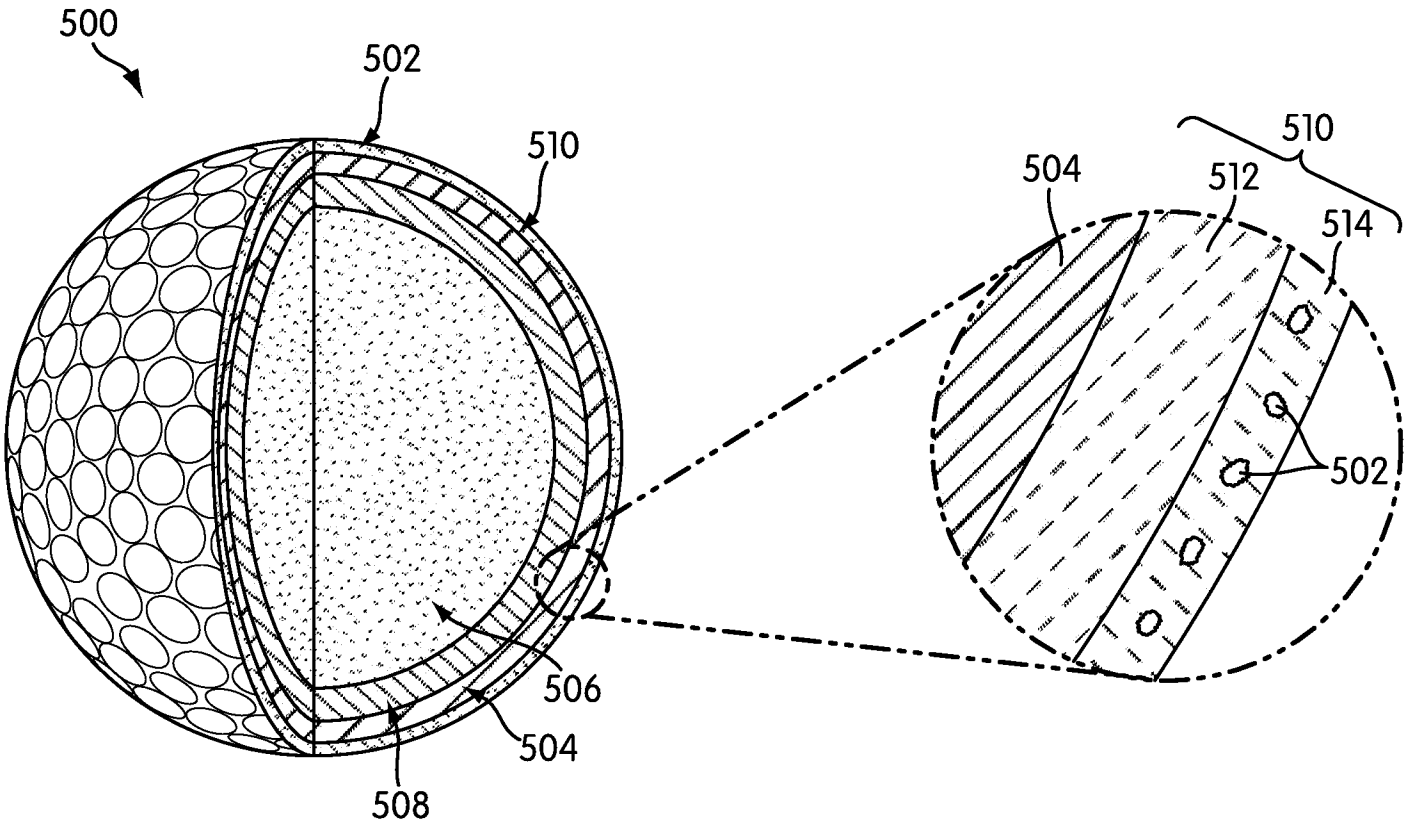
FIG. 5 shows a second embodiment of a three-piece golf ball having a coating layer that includes carbon dioxide absorbents.

Alternatively, a coating layer may include a primer layer. FIG. 5 shows an embodiment of a golf ball 500 that is largely similar to golf ball 400 above except with respect to coating layer 510. Golf ball 500 includes core 506, intermediate layer 508 substantially surrounding core 506, cover layer 504 substantially surrounding intermediate layer 508, and coating layer 510 substantially surrounding cover layer 504. However, unlike coating layer 410 in FIG. 4, coating layer 510 is made up of primer layer 512 and top coat layer 514. Primer layer 512 may be used in order to increase adhesion between cover layer 504 and top coating layer 514, as is generally known in the art of golf ball manufacturing.

In the embodiment shown in FIG. 5, only top coat layer 514 includes carbon dioxide absorbent particles 502. However, in other embodiments that include coating layers made up of a primer layer and a top coat layer, any of the various layers of the golf ball may include carbon dioxide absorbent particles in any combination thereof. For example, in one embodiment, both primer layer 512 and top coat layer 514 may include carbon dioxide absorbent particles 502. In another embodiment, cover layer 504, primer layer 512 and top coat layer 514 may all include carbon dioxide absorbent particles 502. The presence or absence, and loading amount weight percentage, of carbon dioxide absorbent particles 502 in any particular layer may be determined as variously discussed above.

Throughout the above discussed embodiments of various golf balls, each of the plurality of carbon dioxide absorbent particles are directly dispersed into a polymer matrix that corresponds to a structural layer of the golf ball. However, in such embodiments, the carbon dioxide absorbent particles may begin to absorb carbon dioxide immediately upon exposure to the atmosphere. This effect may decrease the amount of carbon dioxide that is absorbed by the golf ball during use, and may even saturate the carbon dioxide absorbents so that no more carbon dioxide can be absorbed. As golfers may desire for their own act of playing golf to directly have a positive environmental impact, this may be less than preferred.

A first method for alleviating this problem may be to manufacture the golf balls under a low carbon dioxide environment, such as under inert gas. However, this approach may be cost prohibitive. Alternatively, or in addition, golf balls as discussed above may be packaged in air-tight packaging immediately after completion of their manufacture. Air-tight packaging may include shrink-wrapping, or sealed containers, for example.

The golf ball would then begin to absorb carbon dioxide from the atmosphere immediately upon being removed from the air-tight packaging, and would become saturated after a certain period of time. This period of time may depend on factors such as the loading weight percentage of carbon dioxide absorbent particles in the golf ball, environmental factors such as moisture level, the permeability of the polymer matrix into which the carbon dioxide absorbent particles are dispersed, and other factors.

Figure 6:
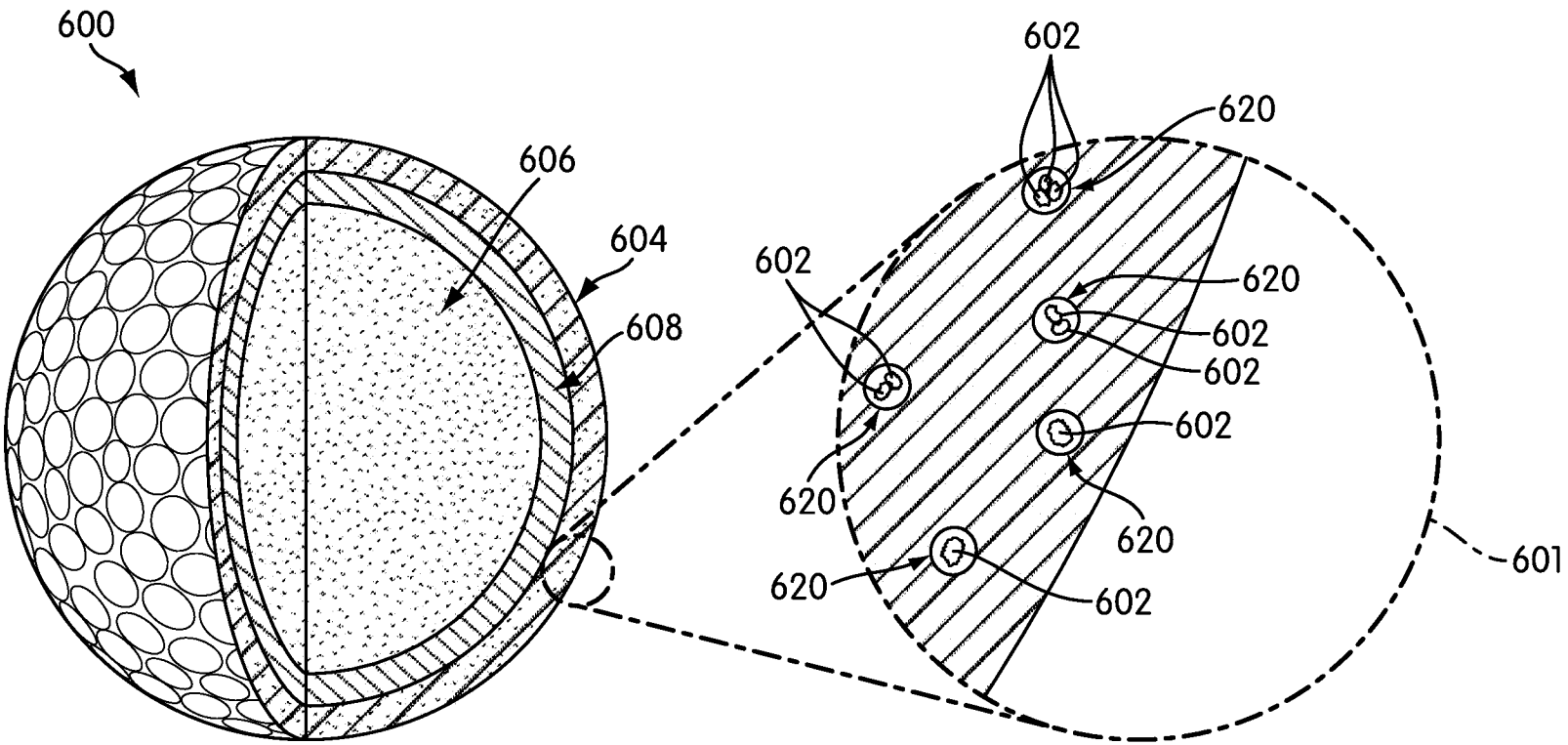
FIG. 6 shows an embodiment of a three-piece golf ball wherein the carbon dioxide absorbents are encapsulated.

One additional way of alleviating this problem, and linking the act of playing golf to a positive environmental impact, may be to encapsulate the carbon dioxide absorbent particles. FIG. 6 shows such an embodiment of a golf ball 600. Cover layer 604 may include carbon dioxide absorbent particles 602, and carbon dioxide absorbent particles 602 may be respectively encapsulated by at least one microcapsule 620. In the particular embodiment shown, carbon dioxide absorbent particles 602 are encapsulated by a plurality of microcapsules 620

The use of microcapsules in golf balls is disclosed generally in U.S. Patent Application Publication No. 2008/0085783 to Isogawa et al., the disclosure of which is hereby incorporated by reference in its entirety. Specifically, the microcapsules disclosed therein are frangible and contain a component that is only released upon rupture of the microcapsule due to the force of an impact between the golf ball and a golf club head face.

Microcapsules 620 may be dispersed in a polymer matrix, just as the various carbon dioxide absorbents discussed above may be dispersed in a polymer matrix. In the embodiment shown in FIG. 6, the polymer matrix corresponds to cover layer 604. However, in other embodiments, microcapsules 620 may be dispersed in any of the various layers of a golf ball, separately or in combination. For example, microcapsules 620 may be dispersed in a core, an intermediate layer, or a coating layer instead of or in addition to being dispersed in a cover layer.

Microcapsules 620 containing carbon dioxide absorbent particles 602 may be present in the polymer matrix in an amount of from about 1% to about 30% by weight of the polymer matrix. In various embodiments, microcapsules 620 containing carbon dioxide absorbent particles 602 may be present in amount of from about 1% to about 20%, or from about 1% to about 10%, or from about 1% to about 5%, or any intermediate points within these ranges. Such weight ranges are measured by the total weight of the microcapsules including the carbon dioxide absorbents therein.

Microcapsules 620 may have a number average particle size of from about 0.5 μm to about 100 μm, or larger. In various embodiments, microcapsules 620 may have a number average particle size of from about 0.5 μm to about 50 μm, or from about 0.5 μm to about 10 μm, or from about 0.5 μm to about 5 μm, or any intermediate points within these ranges. However, in other embodiments the at least one microcapsule 620 may be larger in size, on the order of a millimeter or centimeter. For example, one such relatively larger microcapsule may be present in the center of the core.

In some embodiments, microcapsules 620 may be made of a material that is substantially impermeable to carbon dioxide gas. In such embodiments, the microcapsule may substantially or entirely prevent atmospheric carbon dioxide from reacting with the carbon dioxide absorbent particle 602 therein. Polymer materials that are substantially impermeable to carbon dioxide gas are well known in the art of polymer chemistry, and include materials such as polypropylene or polyethylene terephthalate. U.S. Pat. No. 6,042,638 to Mallow et al., the disclosure of which is hereby incorporated by reference in its entirety, discloses a variety of binder materials that are substantially impermeable to carbon dioxide gas.

In other embodiments, microcapsules 620 may be made of a material that is only at least partially impermeable to carbon dioxide gas. U.S. Pat. No. 6,042,638 to Mallow et al. also discloses such materials. In these embodiments, as a result of being encapsulated inside of microcapsules 620, the rate at which atmospheric carbon dioxide is able to react with carbon dioxide absorbent particles 602 is at least partially reduced, and may be significantly reduced.

Therefore, in any of the various embodiments mentioned directly above, the rate at which carbon dioxide may react with carbon dioxide absorbent particles 602 is at least partially reduced as a result of carbon dioxide absorbent particles 602 being encapsulated within microcapsules 620. In particular embodiments, this rate is substantially zero.

However, this rate may be increased as a result of golf ball 600 being used by a golfer to play a round of golf. For example, in some embodiments, microcapsules 620 may be breakable. Due to being breakable, at least some of the plurality of microcapsules 620 may break open to expose the carbon dioxide absorbent particle 602 therein as a result of a force applied by a golf club face to the golf ball during a drive.

FIG. 7 shows golf ball 600 in use. As shown in FIG. 7, golf ball 600 may be used during a drive. Golfer 700 prepares to drive golf ball 600 by striking golf ball 600 with golf club face 702 in state 704. In state 704, microcapsules 620 completely surround carbon dioxide absorbent particles 602. As a result, in state 704 prior to use, golf ball 600 may not absorb any significant amount of carbon dioxide from the atmosphere because microcapsules 620 may be substantially impermeable to carbon dioxide.

Yet FIG. 7 also shows, in state 706, what may happen to at least some of the plurality of microcapsules after golf ball 600 is struck by a golf club face 702 in a drive. In state 706, golfer 700 has completed her swing and golf ball 600 is driven down the fairway. As a result of the force applied by golf club face 702 to golf ball 600, at least some of microcapsules 624 may break open so as to expose some of the carbon dioxide absorbent particles 622. These particular carbon dioxide absorbent particles 622 may then proceed to react with atmospheric carbon dioxide as indicated by chemical pathway 708. Specifically, carbon dioxide gas is absorbed to form a metal salt and water.

As golfer 700 repeatedly drives golf ball 600 during a round of golf, more of the plurality of microcapsules 620 may break open. Thus, golf ball 600 may serve to reduce greenhouse gasses upon being used by golfer 700, and the act of playing game may be associated with the fight against global warming.

In an alternative embodiment not specifically shown in FIG. 7, the force applied to golf ball 600 by golf club face 702 may increase the rate of carbon dioxide absorbance by plastically deforming microcapsules 620 without breaking them when microcapsules are formed from a material that is only partially impermeable to carbon dioxide gas. As is generally known in the art of chemistry, the rate of diffusion of across a membrane is proportional to the total surface area of that membrane. Prior to use, microcapsules 620 may generally be spherical in shape, and thus have a relatively low surface area to volume ratio. However, as a result of being plastically deformed by the force applied by a golf club head during use, microcapsules may elongate and deform into a shape that has more surface area for the total volume therein. Accordingly, the rate at which carbon dioxide is able to pass through the microcapsule material and react with carbon dioxide absorbent particles therein may be increased.

This disclosure also provides the above discussed golf balls, where a golf ball achieves certain play characteristics. A golf ball in accordance with this disclosure may have a coefficient of restitution at a swing speed of forty meters per second of from about 0.73 to about 0.85. A golf ball may also have a deflection amount under a load of from about 10 to about 130 kilograms of from about 2.2 to about 4.0 millimeters.

When a golf ball in accordance with this disclosure includes a core (such as golf ball 200, golf ball 300, golf ball 400, golf ball 500, or golf ball 60) the innermost core layer may have a coefficient of restitution at a swing speed of forty meters per second of from about 0.77 to about 0.92.

Finally, a golf ball in accordance with this disclosure may also include a visual indicator that shows indicates to a golfer how much carbon dioxide has been absorbed. The visual indicator may be an indirect measure of the amount of carbon dioxide that has been absorbed.

For example, U.S. Patent Application Publication No. 2011/0177883, currently U.S. patent application Ser. No. 12/691,282, entitled Golf Ball Wear Indicator and filed on Jan. 21, 2010, the disclosure of which is hereby incorporated by reference in its entirety, discloses a golf ball wear indicator. The wear on a golf ball's outer layer(s) may be proportional to the number of times that the golf ball has been driven, which in turn may be proportional to the number of microcapsules that have broken open. Accordingly, the wear indicator may be an indirect visual indicator of the amount of carbon dioxide that has been absorbed by a golf ball in accordance with this disclosure.

As another example, a golf ball containing carbon dioxide absorbent particles may include a visual indicator in the form of a color changing ink. The chemical reaction between a carbon dioxide absorbent and atmospheric carbon dioxide may be exothermic, especially in embodiments where the carbon dioxide absorbent is a strong metallic hydroxide base. This exothermic reaction may release heat to a sufficient degree as to raise the local temperature of the polymer matrix in which the carbon dioxide absorbent particle is dispersed. The polymer matrix may therefore include a heat responsive color changing ink so as to act as a visual indicator of the carbon dioxide absorbance reaction.

U.S. Pat. No. 7,226,961 to Park et al. discloses golf balls including thermochromatic compounds that change color in response to heat. Other inks may be known to persons having ordinary skill in the art of thermochromatic compounds, and may be used in golf ball in accordance with this disclosure.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core;

an intermediate layer substantially surrounding the core, the intermediate layer being substantially impermeable to water;

a cover layer substantially surrounding the intermediate layer;

a carbon dioxide absorbent selected from the group consisting of alkaline hydroxides, alkaline oxides, alkali hydroxides, alkali oxides, and mixtures thereof;

the carbon dioxide absorbent being encapsulated within at least one microcapsule;

the at least one microcapsule being frangible, such that the at least one microcapsule breaks as a result of a force applied by a golf club face to the golf ball during a drive, thereby exposing the carbon dioxide absorbent therein to atmospheric carbon dioxide;

the at least one microcapsule being comprised of a material that is substantially impermeable to carbon dioxide; and the at least one microcapsule being dispersed within a polymer matrix, the polymer matrix constituting a structural component of the golf ball.

2. The golf ball of claim 1, wherein the polymer matrix within which the at least one microcapsule is dispersed corresponds to the cover layer.

3. The golf ball of claim 1, wherein:

the golf ball further comprises a coating layer substantially surrounding the cover layer; and the polymer matrix within which the at least one microcapsule is dispersed corresponds to the coating layer.

4. The golf ball of claim 1, wherein the carbon dioxide absorbent is present in an amount of from about 1% to about 30% by weight of the polymer matrix.

5. The golf ball of claim 1, wherein:

the carbon dioxide absorbent is encapsulated within a plurality of microcapsules; and the plurality of microcapsules have a number average particle diameter of from about 0.5 μm to about 100 μm.

6. The golf ball of claim 1, wherein the carbon dioxide absorbent is selected from the group consisting of CaO, $Ca(OH)_2$, NaOH, LiOH, KOH, and mixtures thereof.

7. A golf ball comprising:

a carbon dioxide absorbent selected from the group consisting of alkaline hydroxides, alkaline oxides, alkali hydroxides, alkali oxides, and mixtures thereof;

the carbon dioxide absorbent being dispersed within a polymer matrix, the polymer matrix constituting a structural component of the golf ball;

wherein the golf ball further comprises a coating layer substantially surrounding a cover layer; and the polymer matrix within which the carbon dioxide absorbent is dispersed corresponds to the coating layer; and wherein the carbon dioxide absorbent is encapsulated within at least one microcapsule;

wherein the at least one microcapsule is comprised of a material that is substantially impermeable to carbon dioxide gas;

wherein the at least one microcapsule is frangible, such that the at least one microcapsule breaks as a result of a force applied by a golf club face to the golf ball during a drive, thereby exposing the carbon dioxide absorbent contained within the at least one microcapsule to atmospheric carbon dioxide; and wherein the at least one microcapsule is dispersed within the polymer matrix.

8. The golf ball of claim 7, wherein the golf ball includes a visual indicator that indicates to a golfer an amount of carbon dioxide that has been absorbed.

9. The golf ball of claim 7, wherein the polymer matrix within which the carbon dioxide absorbent is dispersed corresponds to the cover layer.

10. The golf ball of claim 7, wherein:

the coating layer comprises a primer layer disposed adjacent to the cover layer, and a top-coating layer disposed over the primer layer; and the carbon dioxide absorbent is dispersed within at least one of the primer layer and the top-coating layer.

11. The golf ball of claim 7, wherein the golf ball undergoes a weight increase after the carbon dioxide absorbent absorbs atmospheric carbon dioxide.

12. The golf ball of claim 7, wherein the carbon dioxide absorbent is selected from the group consisting of CaO, $Ca(OH)_2$, NaOH, LiOH, KOH, and mixtures thereof.

13. The golf ball of claim 7, wherein:

the carbon dioxide absorbent is encapsulated within a plurality of microcapsules; and the plurality of microcapsules have a number average particle diameter of from about 0.5 μm to about 100 μm.

14. A golf ball comprising:

a core;

an intermediate layer substantially surrounding the core, the intermediate layer being substantially impermeable to water;

a cover layer substantially surrounding the intermediate layer;

a carbon dioxide absorbent selected from the group consisting of alkaline hydroxides, alkaline oxides, alkali hydroxides, alkali oxides, and mixtures thereof;

the carbon dioxide absorbent being dispersed within a polymer matrix, the polymer matrix corresponding to the cover layer;

wherein the golf ball includes a visual indicator that indicates to a golfer an amount of carbon dioxide that has been absorbed.

15. The golf ball of claim 14, wherein the intermediate layer is comprised of a hydrophobic thermoplastic polyurethane.

16. The golf ball of claim 14, wherein the carbon dioxide absorbent is selected from the group consisting of CaO, $Ca(OH)_2$, NaOH, LiOH, KOH, and mixtures thereof.

17. The golf ball of claim 14, wherein the carbon dioxide absorbent is encapsulated within a plurality of microcapsules;

the plurality of microcapsules being comprised of a material that is substantially impermeable to carbon dioxide;

the plurality of microcapsules having a number average particle diameter of from about 0.5 μm to about 100 μm;

the plurality of microcapsules being frangible, such that at least some of the plurality of microcapsules break as a result of a force applied by a golf club face to the golf ball during a drive; and the plurality of microcapsules being dispersed within the polymer matrix.

* * * * *